US009603463B2

(12) United States Patent
Varney et al.

(10) Patent No.: US 9,603,463 B2
(45) Date of Patent: Mar. 28, 2017

(54) CHAIR WITH RECLINING SEAT BACK

(71) Applicant: Dorel Juvenile Group, Inc., Foxboro, MA (US)

(72) Inventors: James R Varney, Maynard, MA (US); John A MacNeill, Acton, MA (US); Scott A Leclerc, Ashby, MA (US); James M Ormond, Belmont, MA (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 163 days.

(21) Appl. No.: 14/538,228

(22) Filed: Nov. 11, 2014

(65) Prior Publication Data

US 2015/0130243 A1 May 14, 2015

Related U.S. Application Data

(60) Provisional application No. 61/902,580, filed on Nov. 11, 2013.

(51) Int. Cl.

| | |
|---|---|
| ***A47C 1/024*** | (2006.01) |
| ***A47D 1/00*** | (2006.01) |
| ***A47C 1/026*** | (2006.01) |
| ***A47C 7/54*** | (2006.01) |

(52) U.S. Cl.

CPC ..... *A47D 1/002* (2013.01); *A47C 1/026* (2013.01); *A47C 7/54* (2013.01)

(58) Field of Classification Search

CPC ..... A47D 1/008; A47D 1/103; B60N 2/22
USPC ..... 297/148–155, 354.12
See application file for complete search history.

(56) References Cited

U.S. PATENT DOCUMENTS

| | | | |
|---|---|---|---|
| 2,699,817 | A | 1/1955 | Adler et al. |
| 3,425,744 | A | 2/1969 | Spector et al. |
| 3,649,074 | A | 3/1972 | McDonald et al. |
| 4,696,514 | A | 9/1987 | Maloney |
| 4,723,813 | A | 2/1988 | Kassai |
| 4,938,603 | A | 7/1990 | Turner et al. |
| 5,445,432 | A | 8/1995 | Chien |
| 5,509,719 | A | 4/1996 | Cone |
| 5,609,393 | A | 3/1997 | Meeker et al. |
| 5,669,664 | A | 9/1997 | Perego |
| 6,033,019 | A | 3/2000 | Hession-Kunz et al. |
| 6,050,643 | A | 4/2000 | Kain et al. |
| 6,161,898 | A | 12/2000 | Brevi |
| 6,334,652 | B1 | 1/2002 | Chen et al. |
| 6,666,505 | B2 | 12/2003 | Greger et al. |
| 6,715,827 | B1 | 4/2004 | Chen |
| 6,951,371 | B2 | 10/2005 | Wang |
| 7,008,018 | B2 | 3/2006 | Chen |
| 7,066,542 | B2 | 6/2006 | Wang |
| 7,201,445 | B1 | 4/2007 | Dubiel et al. |
| 7,364,235 | B2 | 4/2008 | Chen et al. |
| 7,419,210 | B2 | 9/2008 | Nolan et al. |
| 7,497,518 | B2 | 3/2009 | Fritz et al. |
| 7,568,758 | B2 | 8/2009 | Troutman et al. |

(Continued)

OTHER PUBLICATIONS

U.S. Appl. No. 13/912,748, filed Jun. 7, 2013.

*Primary Examiner* — David R Dunn
*Assistant Examiner* — Alexander Harrison
(74) *Attorney, Agent, or Firm* — Barnes & Thornburg LLP

(57) ABSTRACT

A juvenile seat assembly includes a seat back mounted for pivotable movement relative to a seat bottom. The seat back can be locked in different positions relative to the seat bottom.

18 Claims, 6 Drawing Sheets

(56) References Cited

U.S. PATENT DOCUMENTS

| | | | | |
|---|---|---|---|---|
| 7,828,381 | B2 | 11/2010 | Barger | |
| 8,157,327 | B2 * | 4/2012 | Tomasi | A47D 1/002 297/148 |
| 8,240,765 | B2 | 8/2012 | Kennedy et al. | |
| 8,287,044 | B2 | 10/2012 | Chen et al. | |
| 8,292,365 | B2 | 10/2012 | Lu et al. | |
| 2003/0102702 | A1 * | 6/2003 | Daley | A47D 1/004 297/250.1 |
| 2009/0001776 | A1 * | 1/2009 | Bearup | A47D 1/002 297/153 |
| 2009/0026823 | A1 * | 1/2009 | Driessen | A47D 1/004 297/344.14 |

* cited by examiner

CHAIR WITH RECLINING SEAT BACK

PRIORITY CLAIM

This application claims priority under 35 U.S.C. §119(e) to U.S. Provisional Application Ser. No. 61/902,580, filed Nov. 11, 2013, which is expressly incorporated by reference herein.

BACKGROUND

The present disclosure relates to a chair, and particularly to a juvenile seat. More particularly, the present disclosure relates to a high chair for young children.

SUMMARY

According to the present disclosure, a juvenile seat assembly includes a frame, a seat bottom coupled to the frame, and a seat back arranged to extend upwardly away from the seat bottom. In illustrative embodiments, the juvenile seat assembly is a high chair adapted for use to feed young children.

In illustrative embodiments, the seat back includes a backrest and a pivot axle coupled to the frame and to the backrest. The pivot axle is configured to support the backrest for pivotable movement about a backrest-pivot axis between an upright position and at least one rearwardly extending reclined position. The seat back further includes backrest anchor means for retaining the backrest in the upright position or one of the reclined positions at the option of a caregiver so that the angular orientation of the backrest relative to the seat bottom can be varied. In illustrative embodiments, the backrest anchor means is coupled to the backrest to move therewith and is configured to engage the frame to establish each angular orientation of the backrest.

In illustrative embodiments, the backrest anchor means includes a right-side backrest lock coupled to a right side of the backrest to move therewith and a left-side backrest lock coupled to a left side of the backrest to move therewith. Each backrest lock includes an anchor tab and is configured normally to cause the anchor tab to engage one of several anchor-tab receivers (e.g., notches) provided in the frame to retain the backrest in an angular orientation relative to the seat bottom that has been selected by the caregiver.

Each backrest lock further includes a tab-release member that is movable by a caregiver to withdraw the anchor tab from a companion anchor-tab receiver provided in the frame to deactivate the backrest lock associated with that moving tab-release member. The backrest is free to be pivoted about the backrest-pivot axis by a caregiver to assume a new angular orientation relative to the seat bottom once the caregiver has deactivated both of the right-side and left-side backrest locks. In illustrative embodiments, a horizontally extending tubular actuator bar is also included in the backrest anchor means and is coupled to each of the laterally spaced-apart right-side and left-side backrest locks. By lifting the actuator bar upwardly, the caregiver simultaneously moves the tab-release members in the backrest locks to withdraw both anchor tabs from the companion anchor-tab receivers provided in the frame.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 7 is an enlarged partial perspective view of a circled region of FIG. 2 showing the anchor tab included in the right-side backrest lock urged by the tab-biasing spring downwardly into a tab-receiving notch formed in a rear portion of the right armrest of the frame to retain the backrest in the upright position and showing a first empty tab-receiving notch associated with a partly reclined first reclined position of the backrest and a second empty tab-receiving notch associated with a fully reclined second reclined position of the backrest;

FIG. 8 is a view similar to FIG. 7 showing upward sliding movement of the slidable retainer unit included in the right-side backrest lock in response to application of an upwardly directed force ($F_{up}$)by a caregiver to a finger grip included in the right-side backrest lock to compress the tab-biasing spring and withdraw the anchor tab from the tab-receiving notch associated with the upright position of the backrest;

FIG. 9 is a view similar to FIGS. 7 and 8 showing rearward pivoting movement of the backrest about the backrest-pivot axis past the partly reclined first reclined position toward the fully reclined second reclined position while the upwardly directed force ($F_{up}$)is applied to the finger grip of the slidable retainer unit by the caregiver;

FIG. 10 is a view similar to FIGS. 7-9 showing continued rearward pivoting movement of the backrest about the backrest pivot axis past the partly reclined first reclined position toward the fully reclined second reclined position to arrive at the fully reclined second reclined position; and FIG. 11 is a view similar to FIGS. 7-10 after release of the slidable retainer unit to allow the tab-biasing spring included in the right-side backrest lock to urge the anchor tab downwardly into the tab-receiving notch associated with the fully reclined second reclined position to retain the backrest in that position.

DETAILED DESCRIPTION

Figure 1:
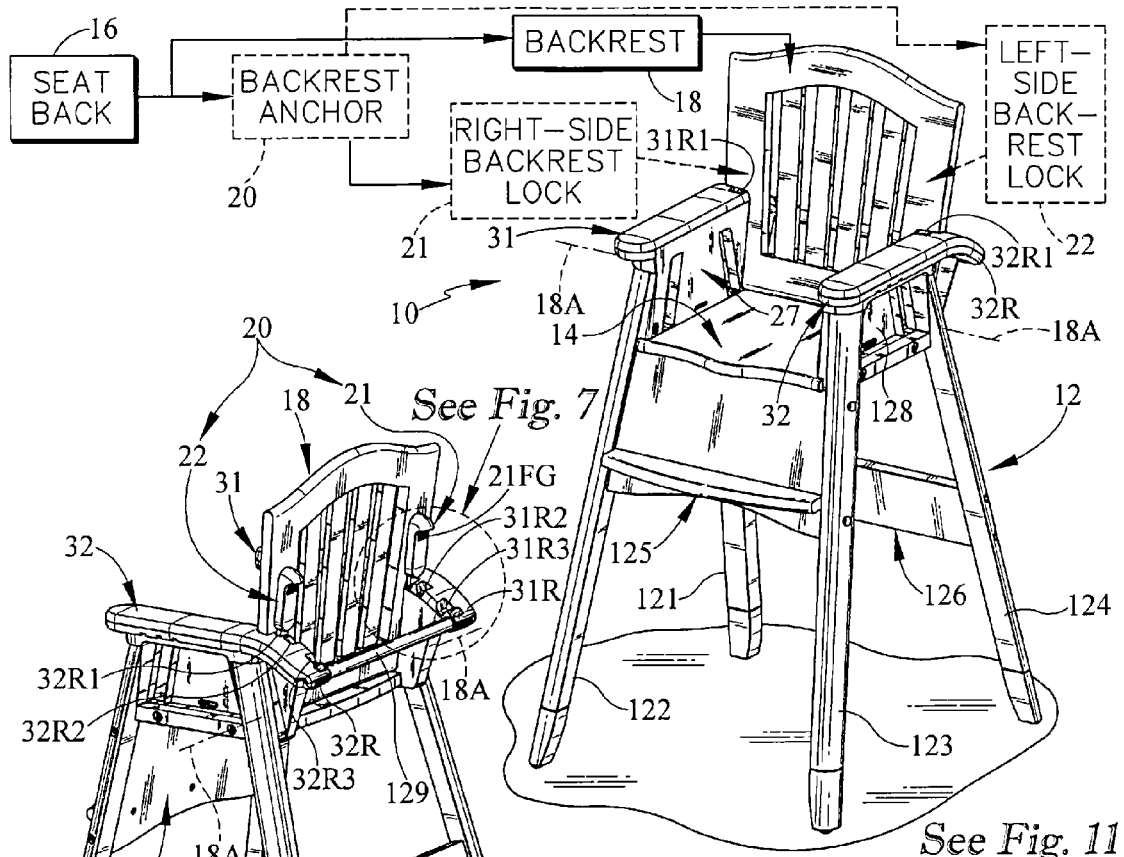
FIG. 1 is a front perspective view of a juvenile seat assembly including a seat bottom, a frame coupled to the seat bottom and configured to support the seat bottom in an elevated position above the ground underlying the juvenile seat assembly, and a seat back including a backrest supported for pivotable movement about a backrest-pivot axis between an upright position shown in FIG. 2 and a rearwardly reclined position shown in FIG. 3 and a backrest anchor including a right-side backrest lock (shown in phantom) and a left-side backrest lock (also shown in phantom)
Figure 2:
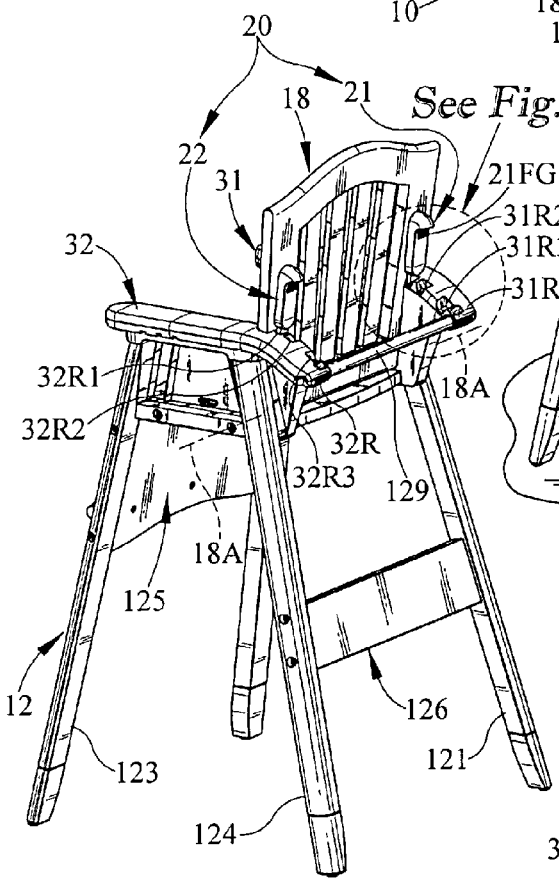
FIG. 2 is a rear perspective view of the juvenile seat assembly of FIG. 1 showing a visible portion of the right-side backrest lock coupled to a right side of a rear surface of the backrest and showing a visible portion of the left-side backrest lock coupled to a left side of a rear surface of the backrest.
Figure 3:
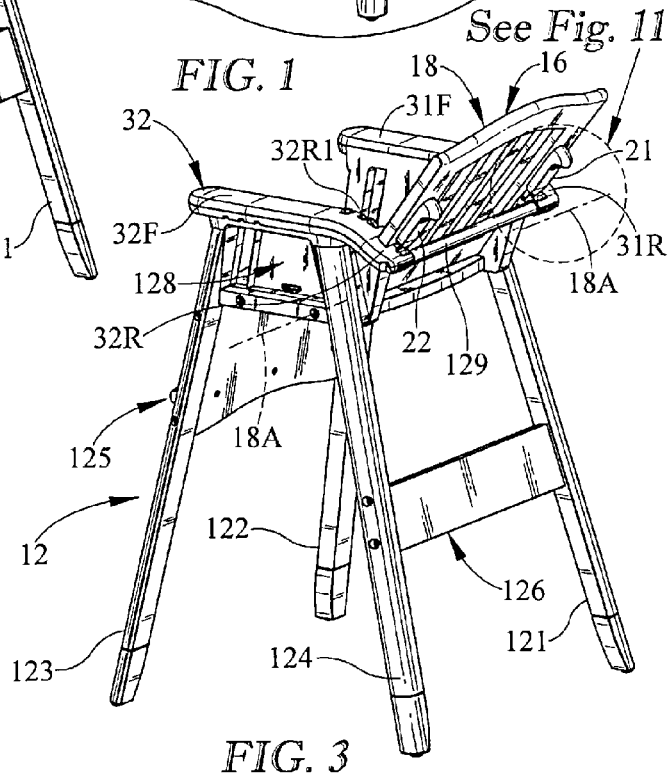
FIG. 3 is a view similar to FIG. 2 showing the backrest retained in a reclined position.

A juvenile seat assembly 10 includes a bottom-support frame 12, a seat bottom 14 coupled to bottom-support frame 12, and a reclineable seat back 16 including a pivotable backrest 18 as shown, for example, in FIGS. 1-3. Seat back 16 also includes a pair of pivot axles 19 coupled to a lower portion of backrest 18 as shown, for example, in FIG. 4. Backrest 18 is supported for pivotable movement about a backrest-pivot axis 18A between an upright position shown in FIGS. 1 and 7, a partly reclined position suggested in FIG. 9, and a fully reclined position shown in FIGS. 3 and 11.

Figure 4:
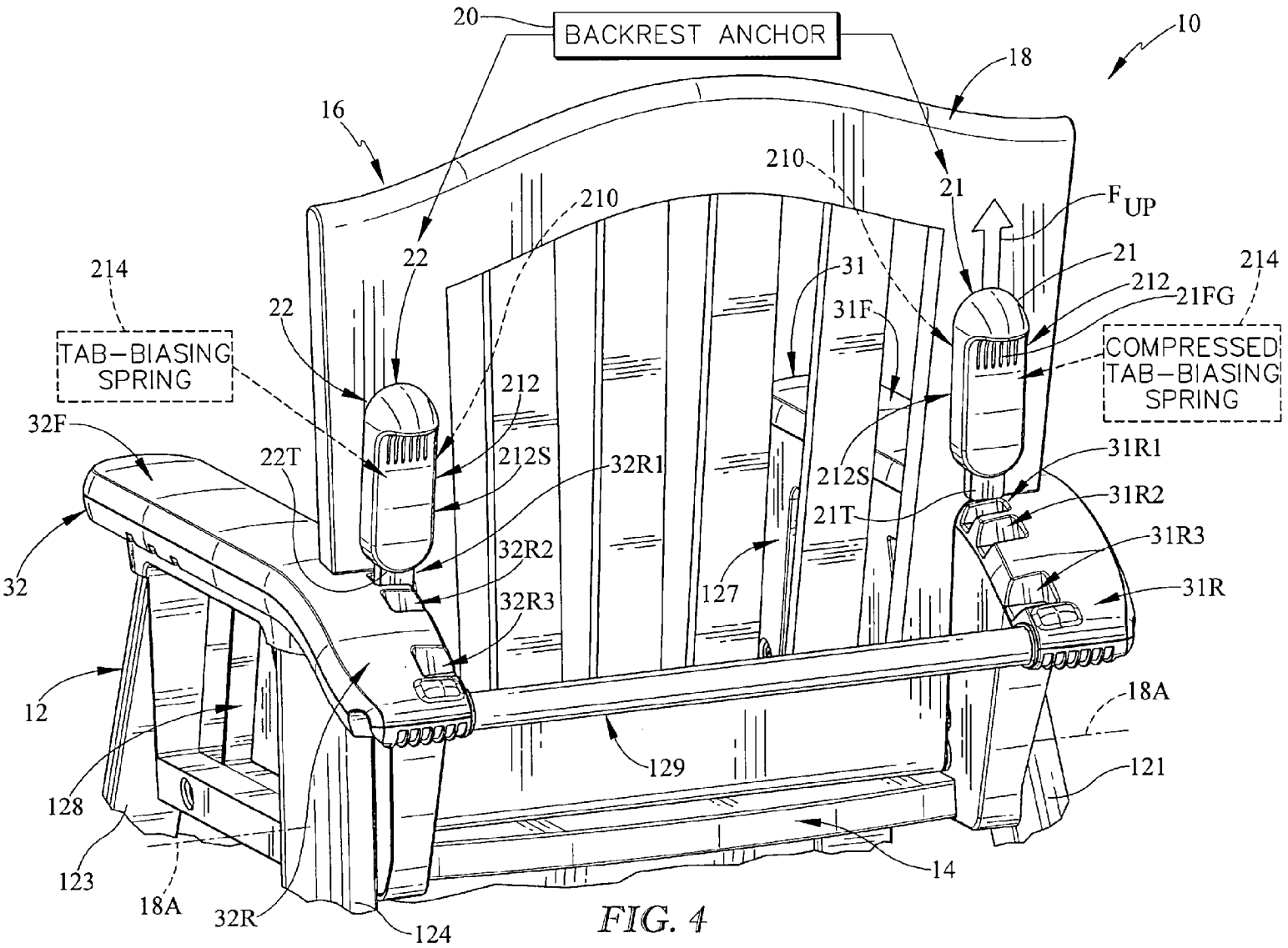
FIG. 4 is an enlarged view of an upper portion of the juvenile seat assembly while the backrest is in the upright position shown in FIG. 2 but after a caregiver has applied an upwardly directed force ($F_{up}$)to a finger grip included in a movable tab-release member included in the right-side backrest lock of the backrest anchor to cause a downwardly extending anchor tab included in the right-side backrest lock to be withdrawn from a companion tab-receiving notch (i.e., anchor-tab receiver) formed in a rear portion of a right-side armrest included in the frame to deactivate the right-side backrest lock and showing that a downwardly extending anchor tab included in the left-side backrest lock of the backrest anchor is urged downwardly into a companion tab-receiving notch formed in a rear portion of a left-side armrest included in the frame by a yieldable tab-biasing spring included in the left-side backrest lock.

A backrest anchor 20 is also included in seat back 12 as suggested diagrammatically in FIG. 1 and illustratively in FIG. 4. Backrest anchor 20 includes a right-side backrest lock 21 coupled to a right-side portion of backrest 18 and a separate left-side backrest lock 22 coupled to a left-side portion of backrest 18 as shown, for example, in FIG. 4. Each backrest lock 21, 22 is operable by a caregiver to lock backrest 18 in either the upright, partly reclined, or fully reclined position. In an illustrative embodiment shown in FIG. 4A, a backrest anchor 20' in a seat back 16' also includes a horizontally extending actuator bar 23. Actuator bar 23 is arranged to interconnect backrest locks 21, 22 to provide means for allowing a caregiver to operate backrest locks 21, 22 simultaneously by moving actuator bar 23 relative to backrest 18.

Each backrest lock 21, 22 is configured to provide means for engaging one of several latch retainers (e.g., notches) provided in bottom-support frame 12 to retain backrest 18 in the upright position or one of the rearwardly reclined positions at the option of a caregiver. In illustrative embodiments, a first rear portion 31R of bottom-support frame 12 is formed to include three upwardly opening tab-receiving notches 31R1, 31R2, and 31R3 associated with right-side backrest lock 21 and a second rear portion 32R of bottom-support frame 12 is formed to include three upwardly opening tab-receiving notches 32R1, 32R2, and 32R3 associated with left-side backrest lock 22. Right-side backrest lock 21 includes a downwardly extending anchor tab 21T sized to extend into one of the upwardly opening tab-receiving notches 31R1, 31R2, and 31R3 to establish an angular orientation of backrest 18 selected by the caregiver. Similarly, left-side backrest lock 22 includes a downwardly extending anchor tab 22T sized to extend into one of the upwardly opening tab-receiving notches 32R1, 32R2, and 32R3.

Bottom-support frame 12 includes four legs 121-124, a footrest 125, a rear strut 126, a right-side panel 127 coupled to seat bottom 14 and arranged to extend between first and second legs 121, 122, and a left-side panel 128 coupled to seat bottom 14 and arranged to extend between third and fourth legs 123,124 in an illustrative embodiment as suggested in FIGS. 1 and 2. Bottom-support frame 12 also includes a right armrest 31 arranged to lie above right-side panel 127 and upper ends of first and second legs 121, 122 as shown, for example, in FIG. 1. Bottom-support frame 12 also includes a left armrest 32 arranged to lie above left-side panel 128 and upper ends of third and fourth legs 123, 124. It is within the scope of the present disclosure to provide bottom-support frame 12 with any suitable shape.

Right armrest 31 includes first rear portion 31R formed to include tab-receiving notches 31R1, 31R2, and 31R3 and a front portion 31F in an illustrative embodiment as shown, for example, in FIGS. 3 and 4. Front portion 31F is arranged to overlie right-side panel 127 and upper ends of legs 121, 122 and to lie in a generally horizontally extending orientation. First rear portion 31 R is coupled to a rearwardly facing end of front portion 31F and extend away from front portion 31F in a downwardly sloping direction as suggested in FIG. 5. Tab-receiving notch 31R1 is formed to lie in close proximity to front portion 31F. Tab-receiving notch 31R3 is formed to lie in spaced-apart relation to tab-receiving notch 31R1. Tab-receiving notch 31R2 is positioned to lie between tab-receiving notches 31R1, 31R3.

Left armrest 32 includes second rear portion 32R formed to include tab-receiving notches 32R1, 32R2, and 32R3 and a front portion 32F in an illustrative embodiment as shown, for example, in FIGS. 3 and 4. Front portion 32F is arranged to overlie left-side panel 128 and upper ends of legs 123, 124 and to lie in a generally horizontally extending orientation. Second rear portion 32R is coupled to a rearwardly facing end of front portion 32F and extend away from front portion 32F in a downwardly sloping direction as suggested in FIG. 5. Tab-receiving notch 32R1 is formed to lie in close proximity to front portion 32F. Tab-receiving notch 32R3 is formed to lie in spaced-apart relation to tab-receiving notch 32R1. Tab-receiving notch 32R2 is positioned to lie between tab-receiving notches 32R1, 32R3.

A rigidifier rail 129 is also included in bottom-support frame 12 in an illustrative embodiment as shown, for example, in FIGS. 2 and 4. A right end of rail 129 is coupled to a free end of first rear portion 31R of right armrest 31. A left end of rail 129 is coupled to a free end of second rear portion 32R of left armrest 32. First rear portion 31R, rail 129, and second rear portion 32R cooperate to form a U-shaped member as suggested in FIGS. 4 and 5.

Figure 5:
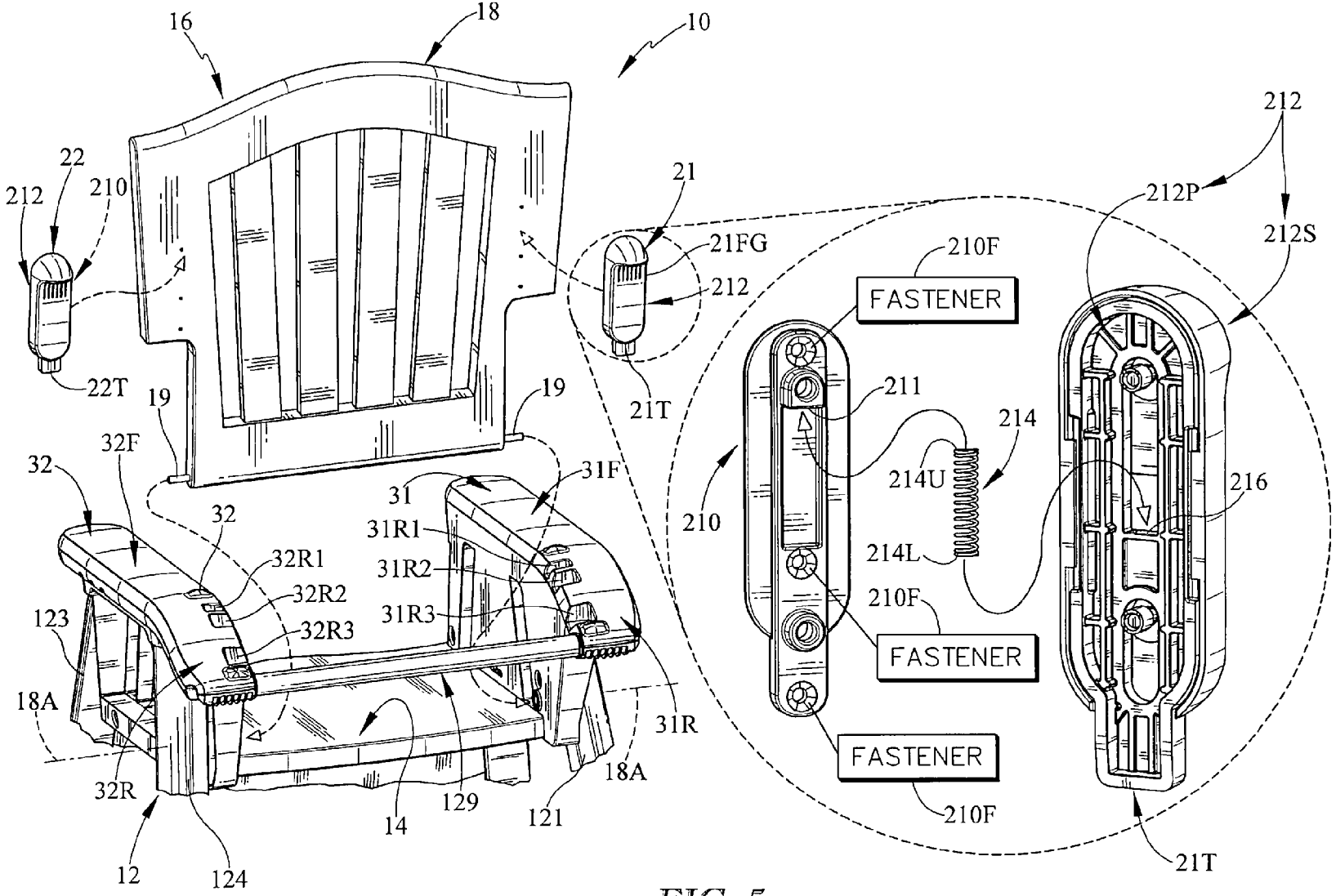
FIG. 5 is an exploded perspective assembly view of several juvenile seat assembly components visible in FIG. 4 showing that the seat back includes a backrest, a pivot axle coupled to a lower portion of the backrest and configured to include right and left pivot posts, a right-side backrest lock, and a left-side backrest lock, and showing that the right-side backrest lock comprises a foundation adapted to be mounted to the backrest and retained in a stationary position using several fasteners, a slidable retainer unit formed to include a downwardly extending anchor tab and arranged to slide up and down on the stationary foundation, and a tab-biasing spring arranged to interconnect and lie between the stationary foundation and the slidable retainer unit.
Figure 6:
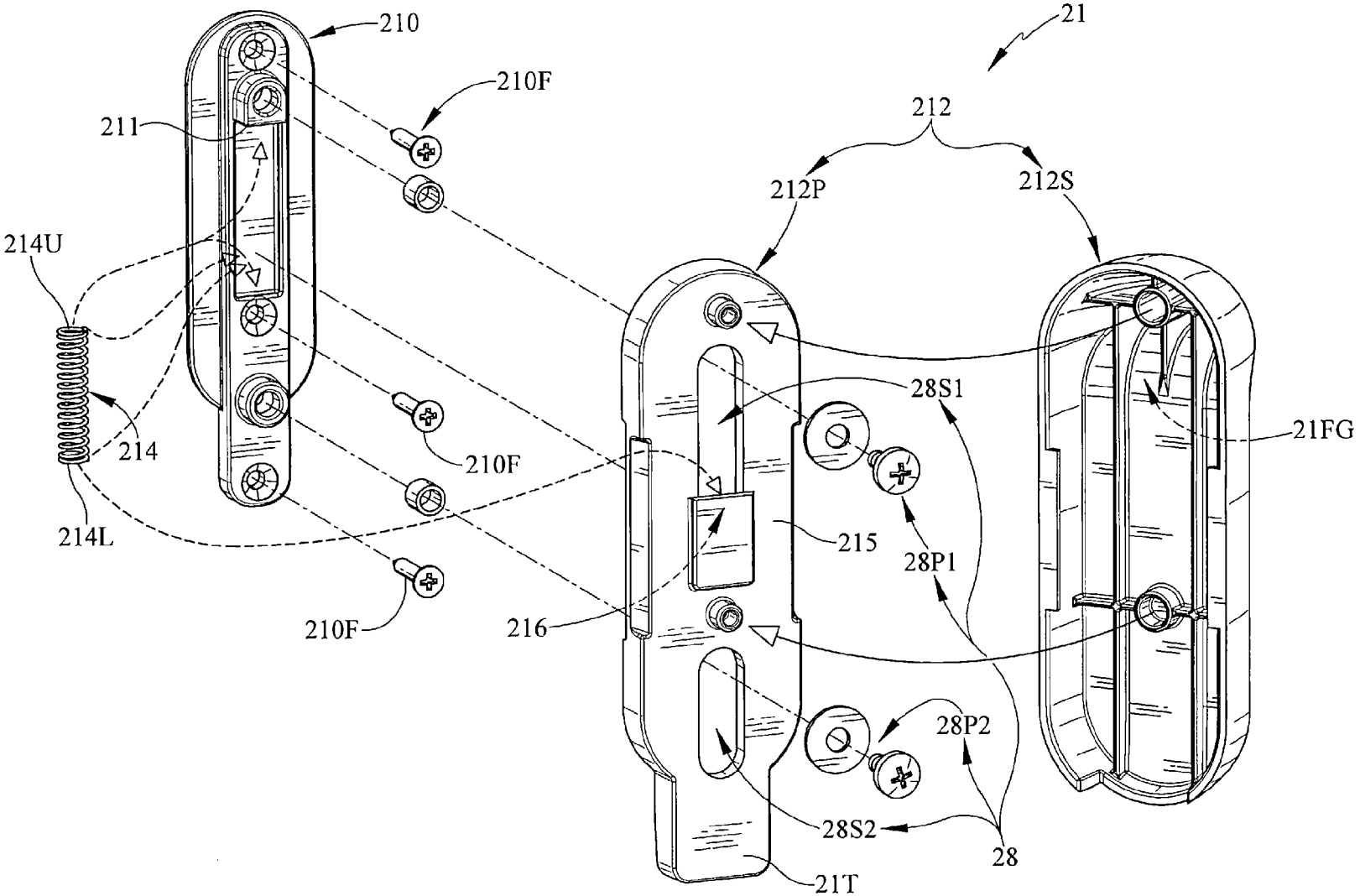
FIG. 6 is an exploded perspective view of the right-side backrest lock.

Right-side backrest lock 21 includes a stationary foundation 210 formed to include an upper spring-engaging flange 211, a slidable retainer unit 212 including downwardly extending anchor tab 21T and an external finger grip 21FG, and a tab-biasing spring 214 as shown, for example, in FIGS. 5 and 6. Tab-biasing spring 214 is arranged to act between stationary foundation 210 and slidable retainer unit 212 normally to urge anchor tab 21T downwardly toward first rear portion 31R of right armrest 31 to cause anchor tab 21T to extend into one of tab-receiving notches 31R1, 31R2, or 31R3 upon arrival of backrest 18 at either the upright, partly reclined, or fully reclined positions as suggested in FIGS. 7-11. The configuration of left-side backrest lock 22 is the same as the configuration of right-side backrest lock 21 in an illustrative embodiment.

Slidable retainer unit 212 includes an inner plate 212P and an outer shell 212S configured to mount in a stationary position on an exterior portion of inner plate 212P as suggested in FIG. 6 Inner plate 212P includes downwardly extending anchor tab 21T, a shell-mount portion 215 coupled to anchor tab 21T, and a lower spring-engaging flange 216 coupled to shell-mount portion 215 as suggested in FIGS. 5 and 6.

Tab-biasing spring 214 is a coiled compression spring that is arranged to lie in space provided between stationary foundation 210 and slidable retainer unit 212 in illustrative embodiments as shown, for example, in FIGS. 5 and 6. An upper end 214U of tab-biasing spring 214 is arranged to engage upper spring-engaging flange 211 included in stationary foundation 210 as suggested in FIGS. 5 and 6. A lower end 214L of tab-biasing spring 214 is arranged to engage lower spring-engaging flange 216 included in slidable retainer unit 212 as suggested in FIG. 5. Tab-biasing spring 214 is configured and mounted to provide means for yieldably urging the slidable retainer unit 212 and its anchor tab 21T in a downward direction relative to the companion stationary foundation 210.

Figure 7:
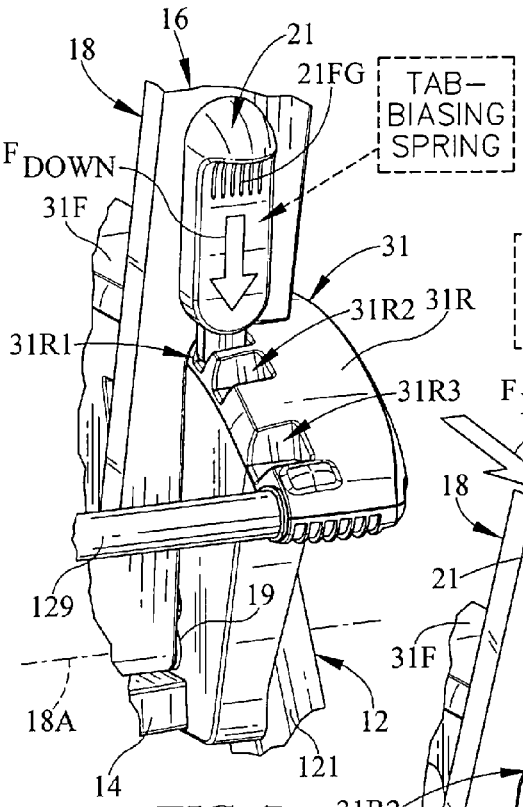
FIGS. 7-11 show a sequence in which the right-side backrest lock is operated by a caregiver to free the backrest to be moved from a locked upright position shown in FIG. 7 to a locked reclined position shown in FIG. 11.
Figure 8:
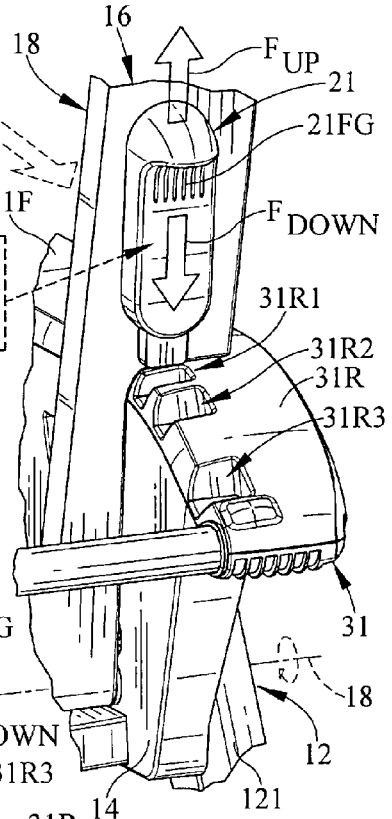

Right-side backrest lock 21 further includes a guide 218 configured to provide means for guiding slidable retainer unit 212 for up-and-down sliding movement relative to stationary foundation 210 (and backrest 18) between a normal lowered position shown, for example, in FIG. 7, and a temporary raised position shown, for example, in FIG. 8. In an illustrative embodiment, guide 218 includes first and second guide posts 218P1, 218P2 coupled to stationary foundation 210 to lie in stationary positions on stationary foundation 210 and first and second post-receiving slots 218S1, 218S2 formed in shell-mount portion 215 of inner plate 212P as shown, for example, in FIG. 6. One assembled, first guide post 218P1 is arranged to slide up and down in first post-receiving slot 218S1 while second guidepost 218P2 is arranged to slide up and down in second post-receiving slot 218S2.

According to the present disclosure, a juvenile seat assembly 10 includes a frame 12, a seat bottom 14 coupled to frame 12, and a seat back 16 arranged to extend upwardly away from seat bottom 14 as shown in FIGS. 1-3. In illustrative embodiments, juvenile seat assembly 10 is a high chair adapted for use to feed young children as suggested in FIGS. 1-3.

In illustrative embodiments, seat back 16 includes a backrest 18 and a pivot axle 19 coupled to frame 12 and to backrest 18 as suggested in FIG. 5. The pivot axle 19 is configured to support backrest 18 for pivotable movement about a backrest-pivot axis 18A between an upright position and at least one rearwardly extending reclined position. The seat back 16 further includes backrest anchor means 20 for retaining backrest 18 in the upright position or one of the reclined positions at the option of a caregiver so that the angular orientation of backrest 18 relative to seat bottom 14 can be varied. In illustrative embodiments, the backrest anchor means 20 includes two backrest locks 21, 22 and each backrest lock 21, 22 is coupled to backrest 18 to move therewith and is configured to engage frame 12 to establish each angular orientation of backrest 18.

In illustrative embodiments, the backrest anchor means 20 includes a right-side backrest lock 21 coupled to a right side of backrest 18 to move therewith and a left-side backrest lock 22 coupled to a left side of backrest 18 to move therewith as suggested in FIGS. 4 and 5. Each backrest lock 21, 22 includes an anchor tab 21T (22T) and is configured normally to cause the anchor tab 21T (22T) to engage one of several anchor-tab receivers (e.g., notches) 31R1, 31R2, 31R3 (32R1, 32R2, 32R3) provided in frame 12 to retain backrest 18 in an angular orientation relative to seat bottom 14 that has been selected by the caregiver. Each backrest lock 21 (22) further includes a tab-release member 212S that is movable by a caregiver to withdraw anchor tab 21T (22T) from a companion anchor-tab receiver provided in frame 12 to deactivate backrest lock 21 (22) associated with that moving tab-release member. The backrest 18 is free to be pivoted about the backrest-pivot axis 18A by a caregiver to assume a new angular orientation relative to seat bottom 14 once the caregiver has deactivated both of the right-side and left-side backrest locks 21 (22).

Figure 4A:
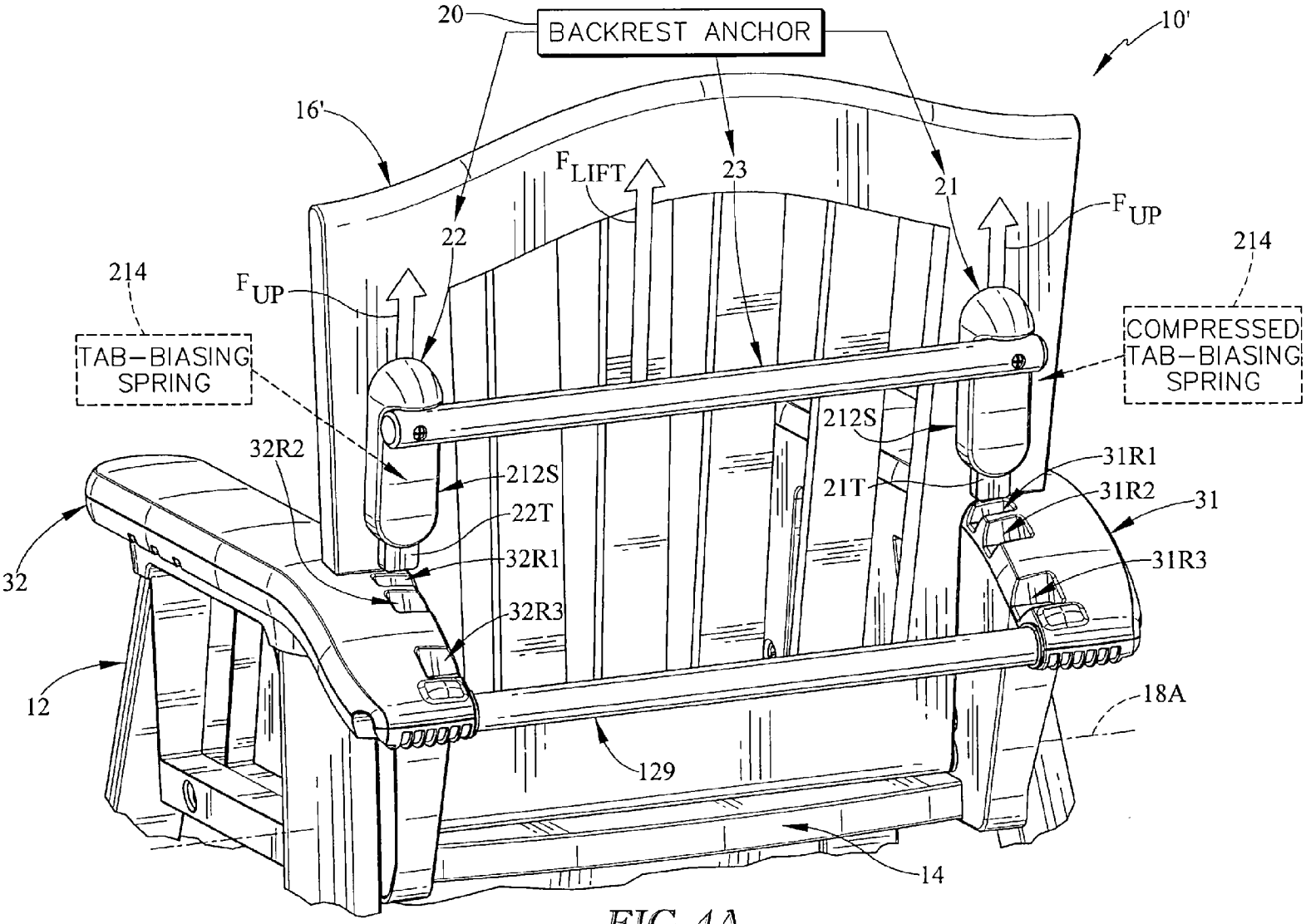
FIG. 4A is a view similar to FIG. 4 showing that the backrest anchor also includes a horizontally extending actuator bar arranged to interconnect the movable tab-release members included in the right-side and left-side backrest locks in another illustrative embodiment.

In another illustrative embodiment shown in FIG. 4A, an actuator bar 23 is also included in a backrest anchor 20' of a seat back 16' of a juvenile seat assembly 10'. Actuator bar 23 is coupled (using any suitable fastener) at a first end to tab-release member 212S of right-side backrest lock 21 and at a second end to tab-release member 212S of left-side backrest lock 22 to provide means for moving the tab-release members 212S, 212S of the backrest locks 21, 22 simultaneously in response to application of a lifting force $F_{LIFT}$ to the actuator bar 23 as suggested in FIG. 4A so that an upwardly directed force $F_{UP}$ is applied simultaneously to each of the tab-release members 212S, 212S to withdraw anchor tabs 21T, 22T from companion anchor tab-receivers formed in frame 12'.

Figure 11:
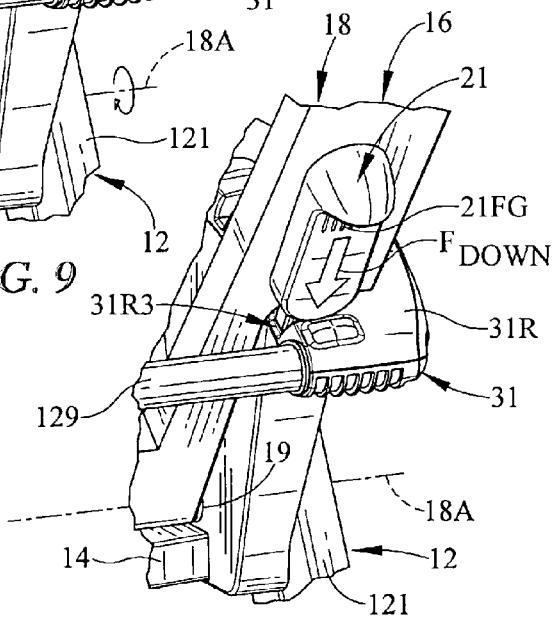

A sequence in which right-side backrest lock 21 is operated by a caregiver to free backrest 18 to be moved from a locked upright position shown in FIG. 7 to a locked reclined position shown in FIG. 11 is provided in FIGS. 7-11. Left-side backrest lock 22 operates in a similar manner.

Anchor tab 21T included in right-side backrest lock 21 is urged by tab-biasing spring 214 downwardly into a tab-receiving notch 31R1 formed in a first rear portion 31R of right armrest 31 of frame 12 to retain backrest 18 in the upright position as shown in FIG. 7. A first empty tab-receiving notch 31R2 associated with a partly reclined first reclined position of backrest 18 and a second empty tab-receiving notch 31R3 associated with a fully reclined second reclined position of backrest 18 is also shown in FIG. 7.

Figure 9:
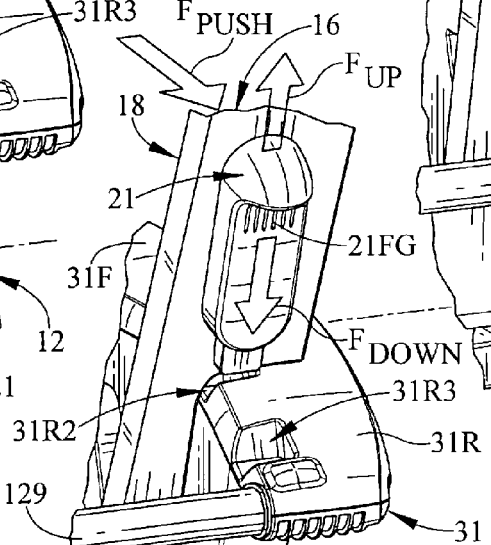
Figure 10:
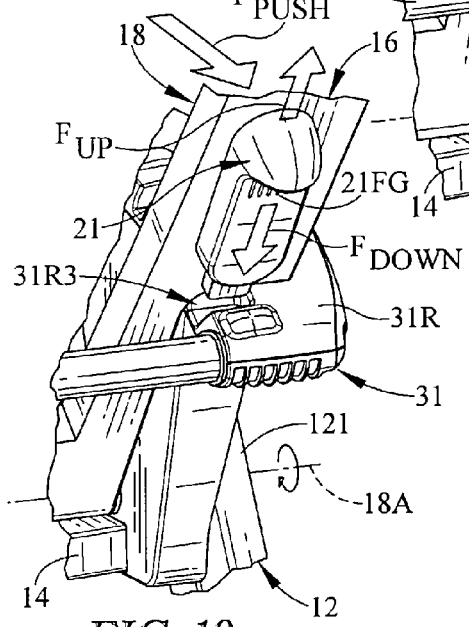

Upward sliding movement of slidable retainer unit 212 included in right-side backrest lock 21 is shown in FIG. 8 in response to application of an upwardly directed force ($F_{up}$) by a caregiver to a finger grip 21FG included in right-side backrest lock 21 to compress tab-biasing spring 214 and withdraw anchor tab 21T from the tab-receiving notch 31R1 associated with the upright position of backrest 18. Rearward pivoting movement of backrest 18 about backrest-pivot axis 18A past the partly reclined first reclined position toward the fully reclined second reclined position is shown in FIG. 9 while the upwardly directed force ($F_{up}$)is applied to the finger grip 21FG of slidable retainer unit 212 by the caregiver.

Continued rearward pivoting movement of backrest 18 about backrest pivot axis 18A past the partly reclined first reclined position toward the fully reclined second reclined position is shown in FIG. 11. Upon arrival of backrest 18 at the second reclined position, a downwardly directed force ($F_{DOWN}$) generated by tab-biasing spring 214 moves anchor tab 21T downwardly into tab-receiving notch 31R3 once the caregiver releases finger grip 21FG of slidable retainer unit 212 of right-side backrest lock 21 as suggested in FIG. 11.

The invention claimed is:

1. A juvenile seat assembly comprising a frame, a seat bottom coupled to the frame and arranged to lie in a horizontal position on the frame in an elevated location above ground underlying the frame, and a seat back including a backrest, a pivot axle coupled to the frame and to the backrest to support the backrest for pivotable movement about a backrest-pivot axis between an upright position and at least one rearwardly extending reclined position to change an angular orientation of the backrest relative to the seat bottom, and backrest anchor means for retaining the backrest in one of the upright position and a first rearwardly extending reclined position at the option of a caregiver so that the angular orientation of the backrest relative to the seat bottom can be varied by the caregiver, wherein the backrest anchor means is coupled to the backrest to move therewith and is arranged to engage the frame to establish each angular orientation of the backrest relative to the seat bottom, wherein the backrest anchor means includes a downwardly extending first movable anchor tab that is constrained to move in upward and downward directions relative to the backrest without any pivotable movement relative to the backrest, the frame includes a first leg unit coupled to a first side of the seat bottom, a second leg unit coupled to an opposite second side of the seat bottom and arranged to lie in spaced-apart relation to the first leg unit, and a first rear portion coupled to the first leg unit and arranged to extend rearwardly in a direction away from the seat bottom, the first rear portion is formed to include a first upwardly opening tab-receiving notch located to receive the downwardly extending first movable anchor tab included in the backrest anchor means to establish the upright position of the backrest and a second upwardly opening tab-receiving notch arranged to lie in spaced-apart relation to a front edge of the seat bottom to locate the first upwardly opening tab-receiving notch therebetween and located to receive the downwardly extending first movable anchor tab included in the backrest anchor means to establish the first rearwardly extending reclined position of the backrest, and wherein the backrest anchor means includes a first backrest lock comprising a stationary foundation, a slidable retainer unit including the downwardly extending first movable anchor tab, and a tab-biasing spring, the stationary foundation is mounted via a fastener on the backrest to move therewith, the slidable retainer unit is mounted for up-and-down sliding movement on the stationary foundation relative to the backrest to move the downwardly extending first movable anchor tab into and out of each of the first and second upwardly opening tab-receiving notches formed in the first rear portion of the frame, and the tab-biasing spring is located and acts between the stationary foundation and the slidable retainer unit normally to urge the downwardly extending first movable anchor tab downwardly toward the first rear portion to cause the downwardly extending first movable anchor tab to extend into one of the tab-receiving notches upon arrival.

2. The juvenile seat assembly of claim 1, wherein the stationary foundation includes an upper spring-engaging flange, the slidable retainer unit includes a lower spring-engaging flange, and the tab-biasing spring is arranged to lie in a space provided between the stationary foundation and the slidable retainer unit and to engage and extend between the upper and lower spring-engaging flanges.

3. The juvenile seat assembly of claim 1, wherein the frame further includes a first armrest comprising the first rear portion and a front portion, the front portion of the first armrest is coupled to the first leg unit and arranged to lie in a generally horizontal orientation to support an arm of a juvenile seated on the seat bottom, the first rear portion is coupled to a rearwardly facing end of the front portion of the first armrest, and the first upwardly opening tab-receiving notch is formed to lie in close proximity to the front portion of the first armrest.

4. The juvenile seat assembly of claim 3, wherein the first rear portion is cantilevered to the front portion of the first armrest.

5. The juvenile seat assembly of claim 3, wherein the first rear portion is arranged to extend away from the front portion of the first armrest in a downwardly sloping direction to provide an upwardly facing inclined top surface formed to include a first aperture opening into the first upwardly opening tab-receiving notch and a second aperture opening into the second upwardly opening tab-receiving notch.

6. The juvenile seat assembly of claim 3, wherein the backrest anchor means includes a first backrest lock comprising a stationary foundation, a slidable retainer unit including the downwardly extending first movable anchor tab, and a tab-biasing spring, the stationary foundation is mounted on the backrest to move therewith, the slidable retainer unit is mounted for up-and-down sliding movement on the stationary foundation relative to the backrest to move the downwardly extending first movable anchor tab into and out of each of the first and second upwardly opening tab-receiving notches formed in the first rear portion of the frame, and the tab-biasing spring is arranged to act between the stationary foundation and the slidable retainer unit normally to urge the downwardly extending first movable anchor tab downwardly toward the first rear portion to cause the downwardly extending first movable anchor tab to extend into one of the tab-receiving notches upon arrival of the backrest at the upright position or the first rearwardly extending reclined position.

7. The juvenile seat assembly of claim 3, wherein the frame further includes a second armrest coupled to the second leg unit and a rigidifier rail having a first end coupled to a free end of the first rear portion of the first armrest and an opposite second end coupled to a free end of the second armrest and the rigidifier rail is arranged to lie in spaced-apart relation to the backrest when the backrest is moved to assume each of the upright and first rearwardly extending reclined positions.

8. The juvenile seat assembly of claim 3, wherein the backrest anchor means further includes a downwardly extending second movable anchor tab arranged to lie in spaced-apart relation to the downwardly extending first anchor tab, the frame further includes a second rear portion coupled to the second leg unit and arranged to extend rearwardly in a direction away from the seat bottom to lie in spaced-apart relation to the first rearward portion, the second rear portion is formed to include a first upwardly opening tab-receiving notch located to receive the downwardly extending second movable anchor tab included in the backrest anchor means to establish the upright position of the backrest and a second upwardly opening tab-receiving notch arranged to lie in spaced-apart relation to a front edge of the seat bottom to locate the first upwardly opening tab-receiving notch therebetween and located to receive the downwardly extending second movable anchor tab included in the backrest anchor means to establish the first rearwardly extending reclined position of the backrest, and wherein the frame further includes a second armrest comprising the second rear portion and a front portion, the front portion of the second armrest is coupled to the second leg unit and arranged to lie in a generally horizontal orientation in spaced-apart relation to the front portion of the first armrest to support an arm of a juvenile seated on the seat bottom, the second rear portion is coupled to a rearwardly facing end of the front portion of the second armrest, and the first upwardly opening tab-receiving notch of the second rear portion is formed to lie in close proximity to the front portion of the second armrest.

9. The juvenile seat of claim 8, wherein the frame further includes a rigidifier rail having a first end coupled to a free end of the first rear portion of the first armrest and a second end coupled to a free end of the second rear portion of the second armrest and the rigidifier rail is arranged to lie in spaced-apart relation to the backrest when the backrest is moved to assume each of the upright and first rearwardly extending reclined positions.

10. A juvenile seat assembly comprising a frame, a seat bottom coupled to the frame and arranged to lie in a horizontal position on the frame in an elevated location above ground underlying the frame, and a seat back including a backrest, a pivot axle coupled to the frame and to the backrest to support the backrest for pivotable movement about a backrest-pivot axis between an upright position and at least one rearwardly extending reclined position to change an angular orientation of the backrest relative to the seat bottom, and backrest anchor means for retaining the backrest in one of the upright position and a first rearwardly extending reclined position at the option of a caregiver so that the angular orientation of the backrest relative to the seat bottom can be varied by the caregiver, wherein the backrest anchor means is coupled to the backrest to move therewith and is arranged to engage the frame to establish each angular orientation of the backrest relative to the seat bottom, wherein the backrest anchor means includes a downwardly extending first movable anchor tab that is constrained to move in upward and downward directions relative to the backrest without any pivotable movement relative to the backrest, the frame includes a first leg unit coupled to a first side of the seat bottom, a second leg unit coupled to an opposite second side of the seat bottom and arranged to lie in spaced-apart relation to the first leg unit, and a first rear portion coupled to the first leg unit and arranged to extend rearwardly in a direction away from the seat bottom, the first rear portion is formed to include a first upwardly opening tab-receiving notch located to receive the downwardly extending first movable anchor tab included in the backrest anchor means to establish the upright position of the backrest and a second upwardly opening tab-receiving notch arranged to lie in spaced-apart relation to a front edge of the seat bottom to locate the first upwardly opening tab-receiving notch therebetween and located to receive the downwardly extending first movable anchor tab included in the backrest anchor means to establish the first rearwardly extending reclined position of the backrest, and wherein the backrest anchor means includes a first backrest lock comprising a stationary foundation, a slidable retainer unit including the downwardly extending first movable anchor tab, and a tab-biasing spring, the stationary foundation is mounted on the backrest to move therewith, the slidable retainer unit is mounted for up-and-down sliding movement on the stationary foundation relative to the backrest to move the downwardly extending first movable anchor tab into and out of each of the first and second upwardly opening tab-receiving notches formed in the first rear portion of the frame, and the tab-biasing spring is arranged to act between the stationary foundation and the slidable retainer unit normally to urge the downwardly extending first movable anchor tab downwardly toward the first rear portion to cause the downwardly extending first movable anchor tab to extend into one of the tab-receiving notches upon arrival, wherein the stationary foundation includes an upper spring-engaging flange, the slidable retainer unit includes a lower spring-engaging flange, and the tab-biasing spring is arranged to lie in a space provided between the stationary foundation and the slidable retainer unit and to engage and extend between the upper and lower spring-engaging flanges, wherein the slidable retainer unit further includes an inner plate including the downwardly extending first movable anchor tab and a shell-mount portion coupled to the downwardly extending first movable anchor tab, the lower spring-engaging flange is coupled to the shell-mount portion, and the slidable retainer unit further includes an outer shell coupled to the inner plate to cover the tab-biasing spring without covering the downwardly extending first movable anchor tab.

11. A juvenile seat assembly comprising a frame, a seat bottom coupled to the frame and arranged to lie in a horizontal position on the frame in an elevated location above ground underlying the frame, and a seat back including a backrest, a pivot axle coupled to the frame and to the backrest to support the backrest for pivotable movement about a backrest-pivot axis between an upright position and at least one rearwardly extending reclined position to change an angular orientation of the backrest relative to the seat bottom, and backrest anchor means for retaining the backrest in one of the upright position and a first rearwardly extending reclined position at the option of a caregiver so that the angular orientation of the backrest relative to the seat bottom can be varied by the caregiver, wherein the backrest anchor means is coupled to the backrest to move therewith and is arranged to engage the frame to establish each angular orientation of the backrest relative to the seat bottom, wherein the backrest anchor means includes a downwardly extending first movable anchor tab that is constrained to move in upward and downward directions relative to the backrest without any pivotable movement relative to the backrest, the frame includes a first leg unit coupled to a first side of the seat bottom, a second leg unit coupled to an opposite second side of the seat bottom and arranged to lie in spaced-apart relation to the first leg unit, and a first rear portion coupled to the first leg unit and arranged to extend rearwardly in a direction away from the seat bottom, the first rear portion is formed to include a first upwardly opening tab-receiving notch located to receive the downwardly extending first movable anchor tab included in the backrest anchor means to establish the upright position of the backrest and a second upwardly opening tab-receiving notch arranged to lie in spaced-apart relation to a front edge of the seat bottom to locate the first upwardly opening tab-receiving notch therebetween and located to receive the downwardly extending first movable anchor tab included in the backrest anchor means to establish the first rearwardly extending reclined position of the backrest, wherein the backrest anchor means further includes a downwardly extending second movable anchor tab arranged to lie in spaced-apart relation to the downwardly extending first anchor tab, the frame further includes a second rear portion coupled to the second leg unit and arranged to extend rearwardly in a direction away from the seat bottom to lie in spaced-apart relation to the first rearward portion, the second rear portion is formed to include a first upwardly opening tab-receiving notch located to receive the downwardly extending second movable anchor tab included in the backrest anchor means to establish the upright position of the backrest and a second upwardly opening tab-receiving notch arranged to lie in spaced-apart relation to a front edge of the seat bottom to locate the first upwardly opening tab-receiving notch therebetween and located to receive the downwardly extending second movable anchor tab included in the backrest anchor means to establish the first rearwardly extending reclined position of the backrest, and wherein the frame further includes a second armrest comprising the second rear portion and a front portion, the front portion of the second armrest is coupled to the second leg unit and arranged to lie in a generally horizontal orientation in spaced-apart relation to the front portion of the first armrest to support an arm of a juvenile seated on the seat bottom, the second rear portion is coupled to a rearwardly facing end of the front portion of the second armrest, and the first upwardly opening tab-receiving notch of the second rear portion is formed to lie in close proximity to the front portion of the second armrest, wherein the backrest anchor means includes a first backrest lock comprising a stationary foundation, a slidable retainer unit including the downwardly extending first movable anchor tab, and a tab-biasing spring, the stationary foundation is mounted on the backrest to move therewith, the slidable retainer unit is mounted for up-and-down sliding movement on the stationary foundation relative to the backrest to move the downwardly extending first movable anchor tab into and out of each of the first and second upwardly opening tab-receiving notches formed in the first rear portion of the frame, and the tab-biasing spring is arranged to act between the stationary foundation and the slidable retainer unit normally to urge the downwardly extending first movable anchor tab downwardly toward the first rear portion to cause the downwardly extending first movable anchor tab to extend into one of the tab-receiving notches upon arrival of the backrest at the upright position or the first rearwardly extending reclined position, and the backrest anchor means further includes a second backrest lock comprising a second stationary foundation, a second slidable retainer unit including the downwardly extending second movable anchor tab, and a second tab-biasing spring, the second stationary foundation is mounted on the backrest to move therewith, the second slidable retainer unit is mounted for up-and-down sliding movement on the second stationary foundation relative to the backrest to move the downwardly extending second movable anchor tab into and out of each of the first and second upwardly opening tab-receiving notches formed in the second rear portion of the frame, and the second tab-biasing spring is arranged to act between the foundation and the second slidable retainer unit normally to urge the downwardly extending second movable anchor tab downwardly toward the second rear portion to cause the downwardly extending second movable anchor tab to extend into one of the tab-receiving notches formed in the second rear portion upon arrival of the backrest at the upright position or the first rearwardly extending reclined position.

12. The juvenile seat assembly of claim 11, wherein the backrest anchor means further includes a horizontally extending actuator bar coupled to each of the first and second slidable retainer units to provide means for moving the first and second slidable retainer units simultaneously in an upward direction to withdraw the downwardly extending first and second movable anchor tabs from the companion tab-receiving notches.

13. A juvenile seat assembly comprising a frame, a seat bottom coupled to the frame and arranged to lie in a horizontal position on the frame in an elevated location above ground underlying the frame, and a seat back including a backrest, a pivot axle coupled to the frame and to the backrest to support the backrest for pivotable movement about a backrest-pivot axis between an upright position and at least one rearwardly extending reclined position to change an angular orientation of the backrest relative to the seat bottom, and backrest anchor means for retaining the backrest in one of the upright position and a first rearwardly extending reclined position at the option of a caregiver so that the angular orientation of the backrest relative to the seat bottom can be varied by the caregiver, wherein the backrest anchor means is coupled to the backrest to move therewith and is arranged to engage the frame to establish each angular orientation of the backrest relative to the seat bottom, wherein the backrest is supported for pivotable movement between the upright position, a partly reclined position, and a fully reclined position, the frame includes a first latch retainer associated with the upright position, a third latch retainer associated with the fully reclined position, and a second latch retainer positioned to lie between the first and third latch retainer and associated with the partly reclined position, and the backrest anchor means includes a slidable retainer unit that is mounted for non-pivoting up-and-down sliding movement relative to the backrest and to slide downwardly in a direction toward the seat bottom to engage the first latch retainer to establish the upright position of the backrest, the second latch retainer to establish the partly reclined position of the backrest, and the third latch retainer to establish the fully reclined position of the backrest, and wherein the backrest anchor means includes a first backrest lock comprising a stationary foundation, a slidable retainer unit including the downwardly extending first movable anchor tab, and a tab-biasing spring, the stationary foundation is mounted via a fastener on the backrest to move therewith, the slidable retainer unit is mounted for up-and-down sliding movement on the stationary foundation relative to the backrest to move the downwardly extending first movable anchor tab into and out of each of the first and second upwardly opening tab-receiving notches formed in the first rear portion of the frame, and the tab-biasing spring is located and acts between the stationary foundation and the slidable retainer unit normally to urge the downwardly extending first movable anchor tab downwardly toward the first rear portion to cause the downwardly extending first movable anchor tab to extend into one of the tab-receiving notches upon arrival.

14. The juvenile seat assembly of claim 13, wherein the first latch retainer is defined by a first notch formed in the frame and sized to receive a latch included in the backrest anchor means, the second latch retainer is defined by a second notch formed in the frame and sized to receive the latch, and the third latch retainer is defined by a third notch formed in the frame and sized to receive the latch.

15. A juvenile seat assembly comprising a frame, a seat bottom coupled to the frame and arranged to lie in a horizontal position on the frame in an elevated location above ground underlying the frame, and a seat back including a backrest, a pivot axle coupled to the frame and to the backrest to support the backrest for pivotable movement about a backrest-pivot axis between an upright position and at least one rearwardly extending reclined position to change an angular orientation of the backrest relative to the seat bottom, and backrest anchor means for retaining the backrest in one of the upright position and a first rearwardly extending reclined position at the option of a caregiver so that the angular orientation of the backrest relative to the seat bottom can be varied by the caregiver, wherein the backrest anchor means is coupled to the backrest to move therewith and is arranged to engage the frame to establish each angular orientation of the backrest relative to the seat bottom, wherein the backrest anchor means includes a right-side backrest lock coupled to a right side of the backrest to move therewith and a left-side backrest lock coupled to a left side of the backrest to move therewith, and each backrest lock includes an anchor tab arranged to engage one of several anchor-tab receivers provided in the frame to retain the backrest in an angular orientation selected by a caregiver, wherein each backrest lock comprises a stationary foundation mounted on the backrest to move therewith, a slidable retainer unit including the anchor tab and mounted for up-and-down sliding movement on the stationary foundation relative to the backrest to move the anchor tab into and out of a companion one of the anchor-tab receivers, and a tab-biasing spring arranged to act in a generally vertical direction between the stationary foundation and the slidable retainer unit to urge the anchor tab toward the frame and anchor-tab receivers provided in the frame.

16. The juvenile seat assembly of claim 15, wherein each backrest lock further includes a tab-release member that is movable by a caregiver to withdraw the anchor tab from a companion anchor-tab receiver provided in the frame to deactivate the backrest lock associated with that moving tab-release member to free the backrest to be pivoted about the backrest-pivot axis by a caregiver to assume a new angular orientation relative to the seat bottom once the caregiver has deactivated both of the right-side and left-side backrest locks.

17. A juvenile seat assembly comprising a frame, a seat bottom coupled to the frame and arranged to lie in a horizontal position on the frame in an elevated location above ground underlying the frame, and a seat back including a backrest, a pivot axle coupled to the frame and to the backrest to support the backrest for pivotable movement about a backrest-pivot axis between an upright position and at least one rearwardly extending reclined position to change an angular orientation of the backrest relative to the seat bottom, and backrest anchor means for retaining the backrest in one of the upright position and a first rearwardly extending reclined position at the option of a caregiver so that the angular orientation of the backrest relative to the seat bottom can be varied by the caregiver, wherein the backrest anchor means is coupled to the backrest to move therewith and is arranged to engage the frame to establish each angular orientation of the backrest relative to the seat bottom, wherein the backrest anchor means includes a right-side backrest lock coupled to a right side of the backrest to move therewith and a left-side backrest lock coupled to a left side of the backrest to move therewith, and each backrest lock includes an anchor tab arranged to engage one of several anchor-tab receivers provided in the frame to retain the backrest in an angular orientation selected by a caregiver, and each backrest lock includes a stationary foundation and slidable retainer unit, wherein the stationary foundation includes an upper spring-engaging flange, the slidable retainer unit includes a lower spring-engaging flange, and a tab-biasing spring is arranged to lie in a generally vertical orientation in a space provided between the stationary foundation and the slidable retainer unit and to engage and extend between the upper and lower spring-engaging flanges.

18. A juvenile seat assembly comprising a frame, a seat bottom coupled to the frame and arranged to lie in a horizontal position on the frame in an elevated location above ground underlying the frame, and a seat back including a backrest, a pivot axle coupled to the frame and to the backrest to support the backrest for pivotable movement about a backrest-pivot axis between an upright position and at least one rearwardly extending reclined position to change an angular orientation of the backrest relative to the seat bottom, and backrest anchor means for retaining the backrest in one of the upright position and a first rearwardly extending reclined position at the option of a caregiver so that the angular orientation of the backrest relative to the seat bottom can be varied by the caregiver, wherein the backrest anchor means is coupled to the backrest to move therewith and is arranged to engage the frame to establish each angular orientation of the backrest relative to the seat bottom, wherein the backrest anchor means includes a right-side backrest lock coupled to a right side of the backrest to move therewith and a left-side backrest lock coupled to a left side of the backrest to move therewith, and each backrest lock includes an anchor tab arranged to engage one of several anchor-tab receivers provided in the frame to retain the backrest in an angular orientation selected by a caregiver, wherein the backrest anchor means further includes a horizontally extending actuator bar coupled to each of the tab-release members to provide means for moving first and second slidable retainer units simultaneously in an upward direction to withdraw the downwardly extending first and second movable anchor tabs from companion tab-receiving notches.

* * * * *